US011052518B2

(12) United States Patent
Uemura

(10) Patent No.: US 11,052,518 B2
(45) Date of Patent: Jul. 6, 2021

(54) STRIKING TORQUE ADJUSTMENT DEVICE OF HYDRAULIC TORQUE WRENCH

(71) Applicant: Uryu Seisaku Ltd., Osaka (JP)

(72) Inventor: Yoji Uemura, Osaka (JP)

(73) Assignee: Uryu Seisaku Ltd., Osaka (JP)

( * ) Notice: Subject to any disclaimer, the term of this patent is extended or adjusted under 35 U.S.C. 154(b) by 179 days.

(21) Appl. No.: 16/577,414

(22) Filed: Sep. 20, 2019

(65) Prior Publication Data

US 2020/0108490 A1 Apr. 9, 2020

(30) Foreign Application Priority Data

Oct. 3, 2018 (JP) ..... JP2018-188214

(51) Int. Cl.
*B25B 21/00* (2006.01)
*B25B 23/145* (2006.01)
*B25B 21/02* (2006.01)

(52) U.S. Cl.
CPC ..... *B25B 23/1453* (2013.01); *B25B 21/02* (2013.01)

(58) Field of Classification Search
CPC ..... B25B 21/00; B25B 21/004; B25B 21/008; B25B 21/02; B25B 21/023; B25B 21/026; B25B 23/00; B25B 27/00
See application file for complete search history.

(56) References Cited

U.S. PATENT DOCUMENTS 5,531,279 A * 7/1996 Biek ..... B25B 21/02 173/178
6,155,355 A * 12/2000 Holmin ..... B25B 21/02 173/176
2018/0169843 A1* 6/2018 Soderlund ..... B25B 23/1453
2020/0108490 A1* 4/2020 Uemura ..... B25B 23/1453

* cited by examiner

*Primary Examiner* — Lee D Wilson
(74) *Attorney, Agent, or Firm* — Wenderoth, Lind & Ponack, L.L.P.

(57) ABSTRACT

A liner 7 is provided with a cylinder portion 14*a* is formed in parallel to the rotation axis, and also a hydraulic fluid flow path 14*c* is formed which opens to a cylinder portion 14*a* to communicate with the interior of the liner serving as a high-pressure chamber and a low pressure chamber at the time of occurrence of the striking torque, and an automatic relief mechanism 14 is provided in which a cylindrical valve element 14*b* having a cutout portion 14*b*' serving as a flow path for hydraulic oil formed on the outer peripheral surface portion is disposed inside the cylinder portion 14*a* so as to be freely rotatable.

2 Claims, 11 Drawing Sheets

Fig. 3(a)
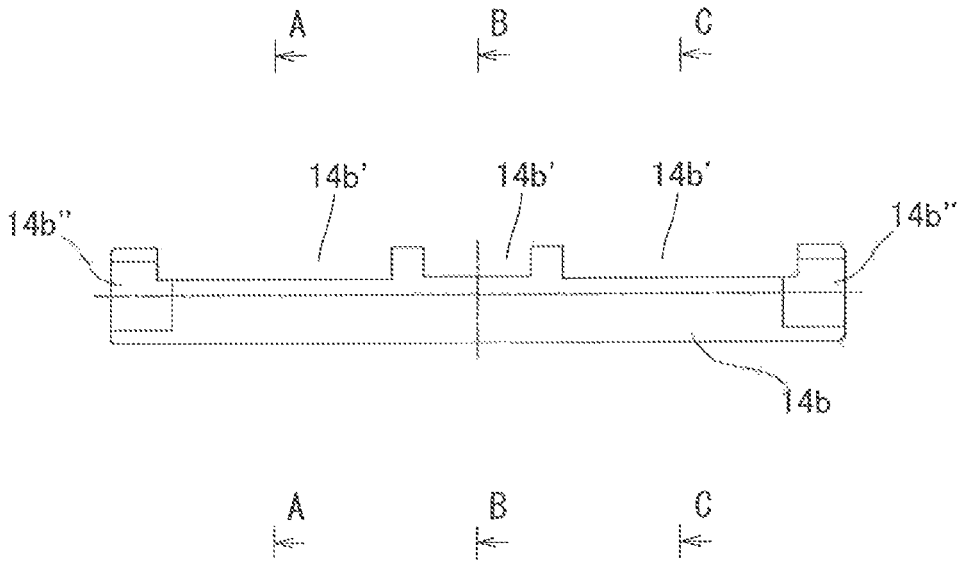
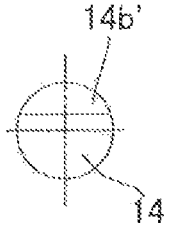
Fig. 3(b)

STRIKING TORQUE ADJUSTMENT DEVICE OF HYDRAULIC TORQUE WRENCH

TECHNICAL FIELD

The present invention relates to a striking torque adjustment device of a hydraulic torque wrench.

BACKGROUND ART

Conventionally, as a striking torque generation device of a torque wrench, a hydraulic torque wrench which uses a hydraulic striking torque generation device with low noise and vibration has been developed and become commercially practical (see Patent Documents 1 and 2, for example).

FIGS. 6 and 7 illustrate an example of the hydraulic torque wrench. A hydraulic torque wrench 1 has a main valve 2 for supplying and stopping high-pressure air, and a normal-reverse rotation switching valve 3 for selectively generating a normal/reverse rotating striking torque so as to drive a rotor 4 which generates a rotating torque by high-pressure air sent via both the valves 2 and 3. A hydraulic striking torque generation device 5 which converts the rotating torque of the rotor 4 into a striking torque is then installed in a case 6 of the hydraulic torque wrench 1.

In the hydraulic striking torque generation device 5, it is configured so that the cavity formed in the liner 7 rotated by the rotor 4 is filled with hydraulic oil and sealed, and a main shaft 8 that is coaxially inserted into the liner 7 is provided with two (or may be one or plural such as three or more) blade insertion grooves, and a blade 9 is inserted into the blade insertion groove. The blade 9 is then energized by the spring 10 in the outer peripheral direction of the main shaft 8 all the time so as to come into contact with the inner peripheral surface of the liner 7.

Furthermore, the striking torque generation device 5 is provided with the output adjustment mechanism 11 which makes it possible to adjust the magnitude of the generated striking torque.

Then, when the liner 7 is rotatably driven by the rotor 4 and thus a plurality of seal surfaces formed on the inner peripheral surface of the liner 7 matches with a seal surface formed on the outer peripheral surface of the main shaft 8 and the blade 9, the strike torque is generated on the main shaft 8 to tighten or loosen a nut and the like engaged with the tip of the main shaft 8.

Then, in the conventional hydraulic torque wrench, the output adjustment mechanism 11 which adjusts the magnitude of the striking torque is configured to operate an operating shaft so as to adjust the size of a hydraulic fluid flow path which communicates the interior of the liner 7 serving as a high-pressure chamber and a low-pressure chamber at the time of occurrence of the striking torque (specifically, the magnitude of the striking torque decreases by operating an operating shaft toward the open side to enlarge the hydraulic fluid flow path so as to decrease, whereas the magnitude of the striking torque increases by operating the operating shaft toward the closed side to reduce the hydraulic fluid flow path).

However, the size of the hydraulic fluid flow path adjusted by operating the operating shaft is constant (fixed) during the operation of the hydraulic torque wrench, thereby causing the following problems (1) to (4).

(1) An error between the actually generated striking torque and the set striking torque is large.

(2) Abnormally high striking torque tends to occur at the time of beginning of tightening operation (when a tightening member is seated).

(3) The resistance after the striking torque is generated (after the pulse is generation) is large and the generation cycle of the striking torque is long.

(4) A load pressure tends to be applied to the seal portion and the durability is poor.

In order to address this problem, the applicant has offered a striking torque adjustment device of a hydraulic torque wrench which is provided with an output adjustment mechanism for adjusting the magnitude of the striking torque which makes it possible to improve the accuracy of the magnitude of the striking torque generated by the striking torque generation device of the hydraulic torque wrench and shorten the generation cycle of the striking torque (Patent Document 3).

FIGS. 8 to 9 illustrate an example of the hydraulic torque wrench. The hydraulic torque wrench 1 is provided with a magnetostrictive torque detection mechanism, and controls the driving of the rotor 4 by an output from the magnetostrictive torque detection mechanism 12.

Then, an output adjustment mechanism 11 is configured to adjust the magnitude of the striking torque by operating an operating shaft 11*a* so as to adjust the size of a hydraulic fluid flow path 11*b* which communicates the interior of a liner 7 serving as a high-pressure chamber H and a low-pressure chamber L at the time of occurrence of the striking torque (specifically, the magnitude of the striking torque decreases by operating the operating shaft 11*a* toward the open side to enlarge (not to restrict) the hydraulic fluid flow path 11*b*, whereas the magnitude of the striking torque increases by operating the operating shaft 11*a* toward the closed side to reduce (restrict) the hydraulic fluid flow path 11*b*).

Furthermore, in the output adjustment mechanism 11, a valve element 11*d* is disposed in the hydraulic fluid flow path 11*b* which is energized by the operation shaft 11*a* and a spring 11*c* in the direction of opening the hydraulic fluid flow path 11*b*, and an oil chamber 11*e* is formed on the rear portion of the valve element 11*d* which communicates with the interior of the liner 7 serving as a high-pressure chamber H at the timer of occurrence of the striking torque is generated is formed. An automatic relief mechanism is then provided in which, when the hydraulic fluid pressure in the high-pressure chamber H rises as the tightening operation proceeds, the hydraulic fluid pressure in the high-pressure chamber H rises in accordance with the progress of the tightening operation, the hydraulic fluid flow path 11*b* becomes smaller (restricted) with increase in the hydraulic fluid pressure in the high-pressure chamber H, as show in FIGS. 9 (*a*) to 9(*b*).

Accordingly, it is possible to improve the accuracy of the magnitude of the striking torque generated by the striking torque generation device of the hydraulic torque wrench and shorten the generation cycle of the striking torque, thereby enhancing the work efficiency of the striking torque generation device of the hydraulic torque wrench.

The striking torque adjustment device of the hydraulic torque wrench 1 disclosed in Patent Document 3 provides excellent working effects described above, however, functions merely at the time of rotating in one direction, i.e., during normal rotation (tightening), and thud did not function during reverse rotation (loosening) so as not to provide the working effects described above.

In order to address this problem, the applicant has offered the striking torque generation device of the hydraulic torque wrench which can increases the accuracy of the magnitude of the striking torque generated by the striking torque generation device of the hydraulic torque wrench at the time of rotating in both directions, i.e., during normal rotation (tightening) and reverse rotation (loosening), shortens the generation period of the striking torque, and also improve the durability of the striking torque generation device of the hydraulic torque wrench (Patent Document 4).

FIGS. 10 and 11 illustrate an example of the hydraulic torque wrench. The output adjustment mechanism 11 which provided in the hydraulic torque wrench 1 to adjust the magnitude of the striking torque forms the hydraulic fluid flow path 11*b* which communicates the interior of a liner 7 serving as the high-pressure chamber H and the low-pressure chamber L at the time of occurrence of the striking torque. A valve element 15*d* is disposed in the hydraulic fluid flow path 11*b* which is energized in the direction of opening the hydraulic fluid flow path 11*b*, and the oil chamber 11*e* is formed on the rear portion of a valve element 15*d* which communicates with a blade insertion portion 8*a* of a main shaft 8 via flow paths 7*c* and 7*d* formed on liner lids 7*a* and 7*b*. An automatic relief mechanism is then provided in which the hydraulic fluid flow path 11*b* becomes smaller (the state shown in the upper side of FIG. 11) with increase in the hydraulic fluid pressure in the blade insertion portion 8*a* of the main shaft 8 which rises in accordance with the increase in the hydraulic fluid pressure in the high-pressure chamber H.

The valve element 15*d* is composed of two valve elements 15*d* disposed so as to face each other across the hydraulic fluid flow path 15*b*, and is energized via a spring 15*c* in a direction to open the hydraulic fluid flow path 15*b*.

Here, in order to stabilize the operation of the two valve element 15*d*, one valve element 15*d* (the right valve element 15*d* in FIG. 10 (*a*)) is formed to be solid, and the other valve element 15*d* (FIG. 10 (In a), the left valve element 15*d*) is formed in a bottomed cylindrical shape, and a spring receiver and guide 15*f* to be inserted into the tubular portion of the left valve body 15*d* formed in a bottomed cylindrical shape is provided to be projected from the right valve body 15*d* formed to be solid.

Then, the two valve elements 15*d* are disposed so as to face each other across the hydraulic fluid flow path 11*b*, and the oil chamber 15*e* is formed on the rear portion of each valve element 15*d* which communicates with the blade insertion portion 8*a* of the main shaft 8 via the flow paths 7*c* and 7*d* formed on the liner lids 7*a* and 7*b*, so that the two valve elements 15*d* move so as to decrease (restrict) the hydraulic fluid flow path 11*b* with increase in the hydraulic fluid pressure in the blade insertion portion 8*a* of the main shaft 8 which rises in accordance with the increase in the hydraulic fluid pressure in the high-pressure chamber H.

PRIOR ART DOCUMENT

Patent Document

[Patent Document 1] JP H03-40076 U
[Patent Document 2] JP H06-297349 A
[Patent Document 3] JP 2009-83090 A
[Patent Document 4] JP 2010-199790 A

SUMMARY OF THE INVENTION

Problems to be Solved by the Invention

Then, the striking torque adjustment device of the hydraulic torque wrench disclosed in Patent Documents 3 and 4 provides excellent working effects described above, however, the problem of durability exists since the springs 11*c* and 11*c* are used for the output adjustment mechanism 11 which adjusts the magnitude of the striking torque. Furthermore, since there is a restriction on the size of the hydraulic fluid flow path at the time of opening, it is difficult to obtain an effect of improving a sufficient energy efficiency. Moreover, since the flow rate of the hydraulic fluid is adjusted by the hydraulic fluid pressure, there has been a problem of being susceptible to fluctuation in oil quantity.

An object of the present invention is to provide a striking torque adjustment device of a hydraulic torque wrench which enjoys the advantages, those which are the striking torque adjustment device of the hydraulic torque wrench disclosed in Patent Document 3 and Patent Document 4 has, of improving the accuracy of the magnitude of the striking torque generated by the striking torque generation device of the hydraulic torque wrench, shortening the generation cycle of the striking torque, while improving the durability and energy efficiency of the striking torque generation device of the hydraulic torque wrench, as well as making the device less susceptible to fluctuation in oil quantity.

Means for Solving the Problem

In order to achieve the object described above, the striking torque adjustment device of the hydraulic torque wrench according to the present invention has a liner rotated by a rotor, and a main shaft and a blade disposed inside of the liner, characterized in that: the liner is provided with a cylinder portion formed in parallel to the rotation axis, and also a hydraulic fluid flow path is formed which opens to the cylinder portion to communicate with the interior of the liner serving as a high-pressure chamber and a low-pressure chamber at the time of occurrence of a striking torque; a cylindrical valve element having a cutout portion serving as a flow path for hydraulic oil formed on the outer peripheral surface portion is disposed inside the cylinder portion so as to be freely rotatable; the rotational position of the valve element changes inside the cylinder portion by means of centrifugal force caused by the revolution of the valve element obtained from rotation of the liner and an inertial force caused by the rotation of the valve element obtained from the sudden braking of the liner at the time of generation of the pulse; and an automatic relief mechanism is provided in which the change in the rotational position of the valve element inside the cylinder portion changes the overlapping area of the hydraulic fluid flow path of the cylinder portion and the cutout portion of the valve element so as to adjust the flow rate of the hydraulic fluid from the side of the high-pressure chamber to the side of the low-pressure chamber via the hydraulic fluid flow path and the cutout portion of the valve element.

In this case, each of the ends of the valve element can be supported by a steel ball.

Effect of the Invention

According to the striking torque adjustment device of the hydraulic torque wrench according to the present invention, it is possible to improve the accuracy of the magnitude of the striking torque generated by a striking torque generation device of the hydraulic torque wrench, shorten the generation cycle of the striking torque, and furthermore improve the durability and energy efficiency of the striking torque generation device of the hydraulic torque wrench, as well as making the device less susceptible to fluctuation in oil quantity.

Furthermore, each of the ends of the valve element is supported by a steel ball, so that it is possible to smoothen the rotational motion of the valve element.

BRIEF DESCRIPTION OF DRAWINGS

FIGS. 3(*a*) and 3(*b*) are explanatory views of a valve element of the striking torque adjustment device of the hydraulic torque wrench: FIG. 3(*a*) is an overall view; and FIG. 3(*b*) is a cross sectional view at A-A, B-B and C-C of FIG. 3(*a*).

FIG. 4(*a*) shows a case of a conventional example (Patent Document 4); and FIG. 4(*b*) shows a case of the embodiments.

FIG. 5(*a*) shows a case of a conventional example (Patent Document 4); and FIG. 5(*b*) shows a case of the embodiments.

FIG. 9(*a*) is a front cross-sectional view of the main part at the time of beginning of the tightening operation;

FIG. 9(*b*) is a front cross-sectional view of the main part in progress of the tightening operation; FIG. 9(*c*) is a cross-sectional view at A-A of FIG. 9(*a*); and FIG. 9(*d*) is a cross-sectional view at B-B of FIG. 9(*a*).

FIG. 10(*a*) is a front cross-sectional view; and FIG. 9(*b*) is a cross-sectional view at A-A of FIG. 9(*a*).

DESCRIPTION OF THE EMBODIMENTS

Embodiments of a striking torque adjustment device of a hydraulic torque wrench according to the present invention will be described below with reference to the drawings.

Figure 1:
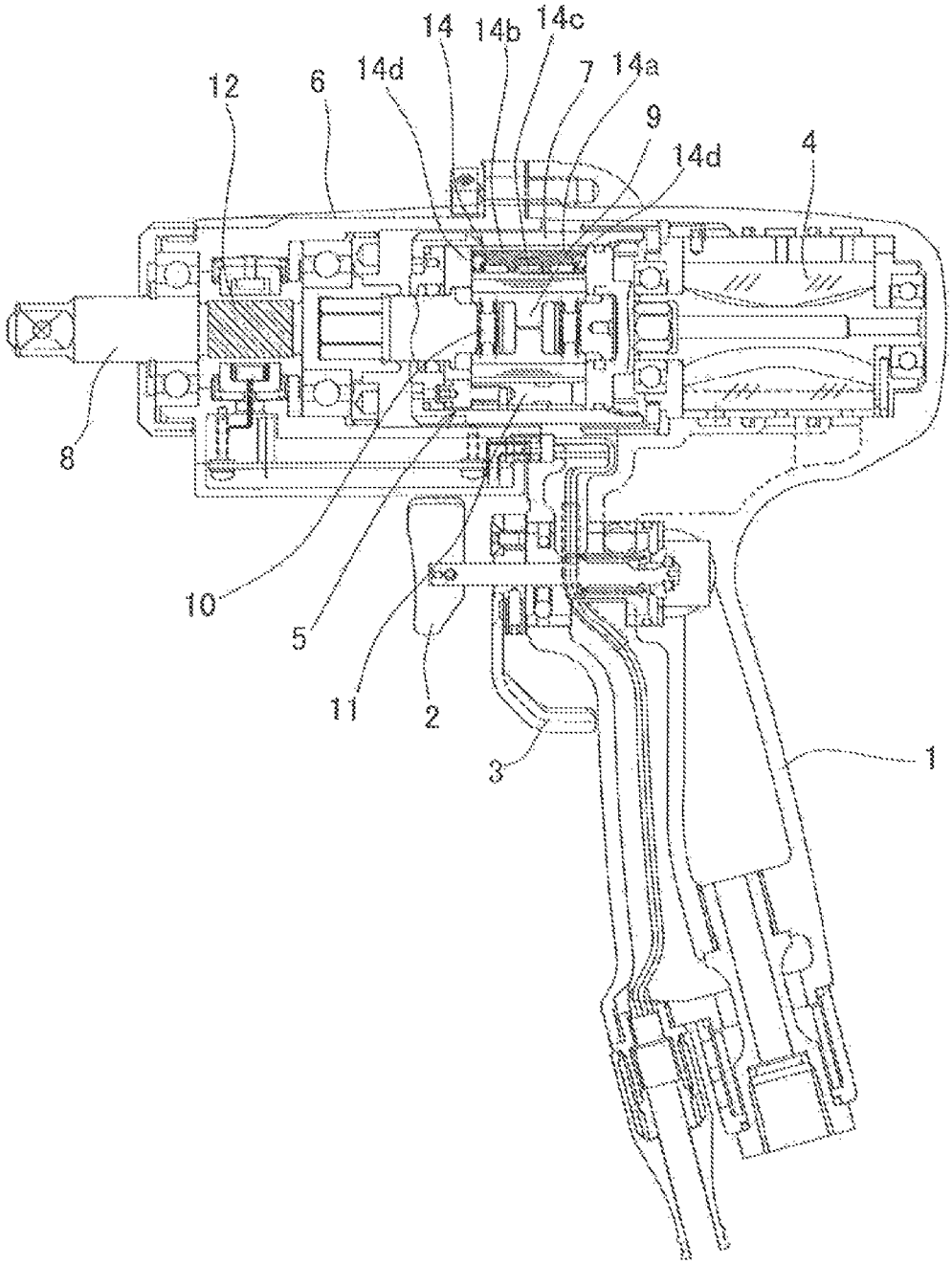
FIG. 1 is an overall front cross-sectional view illustrating an example of a striking torque adjustment device of a hydraulic torque wrench according to the present invention.
Figure 2:
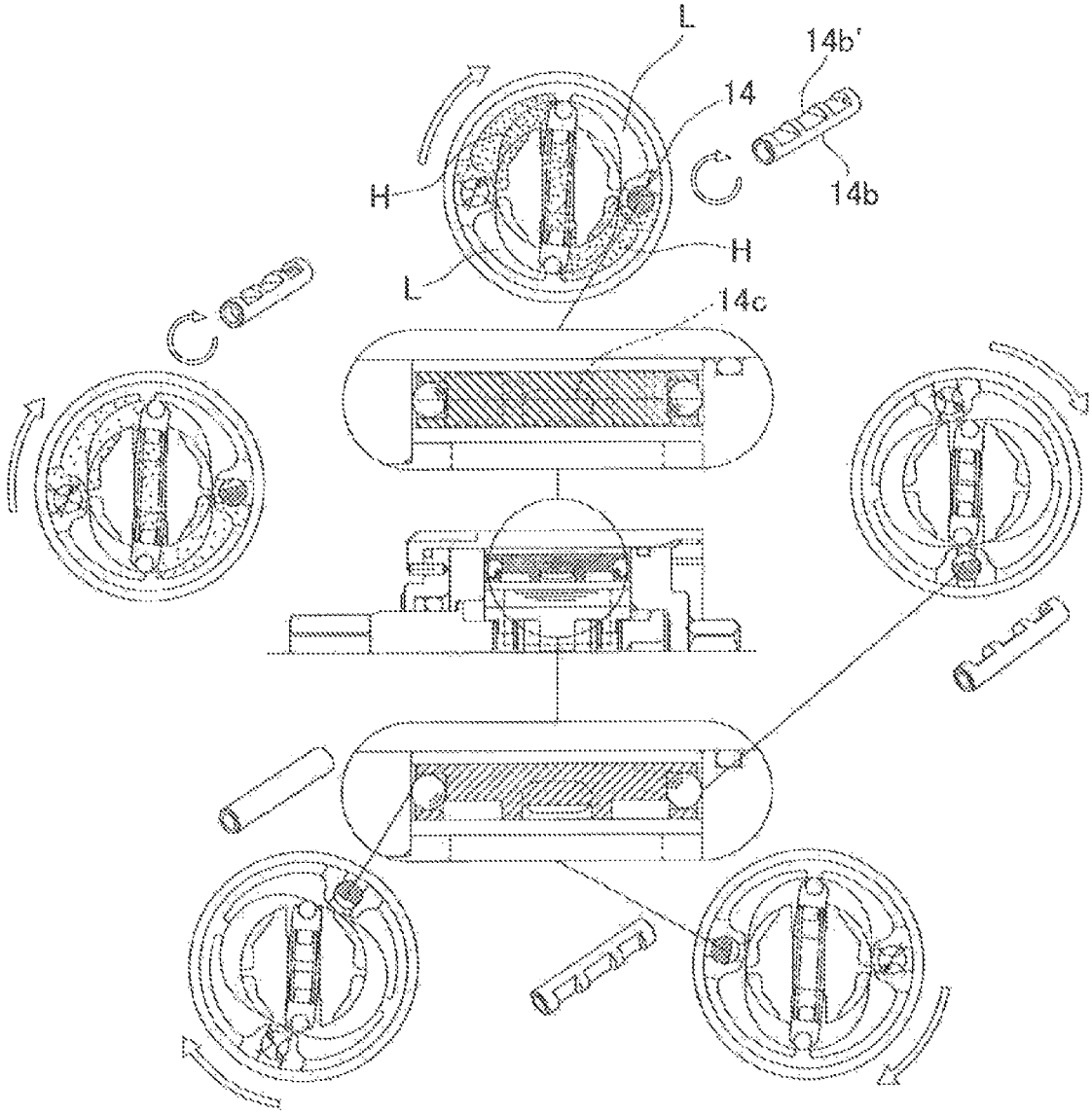
FIG. 2 is an operation explanatory view of the striking torque adjustment device of the hydraulic torque wrench according to the present invention.

FIGS. 1 to 3 illustrate an example of a striking torque adjustment device of a hydraulic torque wrench according to the present invention.

A hydraulic torque wrench 1 is provided with a magnetostrictive torque detection mechanism 12, and controls the driving of a rotor 4 by an output from the magnetostrictive torque detection mechanism 12.

A hydraulic torque wrench 1 is provided with a magnetostrictive torque detection mechanism 12, and the drive of the rotor 4 is controlled by the output of this magnetostrictive torque detection mechanism 12.

Furthermore, an output adjustment mechanism 11 is configured to adjust the magnitude of the striking torque by operating an operating shaft 11*a* so as to adjust the size of a hydraulic fluid flow path 11*b* which communicates the interior of a liner 7 serving as a high-pressure chamber H and a low-pressure chamber L at the time of occurrence of the striking torque (specifically, the magnitude of the striking torque decreases by operating the operating shaft 11*a* toward the open side to enlarge (not to restrict) the hydraulic fluid flow path 11*b*, whereas the magnitude of the striking torque increases by operating the operating shaft 11*a* toward the closed side to reduce (restrict) the hydraulic fluid flow path 11*b*).

In the hydraulic torque wrench 1, the liner 7 is provided with a cylinder portion 14*a* formed in parallel to the rotation axis, and also a hydraulic fluid flow path 14*c* is formed which opens to the cylinder portion 14*a* to communicate with the interior of the liner serving as a high-pressure chamber and a low pressure chamber at the time of occurrence of the striking torque. A cylindrical valve element 14*b* having a cutout portion 14*b*' serving as a flow path for hydraulic oil formed on the outer peripheral surface portion thereof is disposed inside the cylinder portion 14*a* so as to be freely rotatable, so that the rotational position of the valve element 14*b* changes inside the cylinder portion 14*a* by means of centrifugal force caused by the revolution of the valve element 14*b* obtained from rotation of the liner 7 and an inertial force caused by the rotation of the valve element 14*b* obtained from the sudden braking of the liner 7 at the time of generation of the pulse.

Then, an automatic relief mechanism 14 is provided in which the change in the rotational position of the valve element 14*b* inside the cylinder portion 14*a* changes the overlapping area of the hydraulic fluid flow path 14*c* of the cylinder portion 14*a* and the cutout portion 14*b*' of the valve element 14*b* so as to adjust the flow rate of the hydraulic fluid from the side of the high-pressure chamber H to the side of the low-pressure chamber L via the hydraulic fluid flow path 14*c* and the cutout portion 14*b*' of the valve element 14*b*.

As shown in FIGS. 3(*a*) and 3(*b*), in the valve element 14*b* for use in the automatic relief mechanism 14, the center of gravity thereof is offset from the central axis by forming the cutout portion 14*b*' that serves as a hydraulic oil flow path on the peripheral surface of the columnar material.

In this embodiment, the cutout portion 14*b*' is divided into three sections by two partition walls, but can be configured as one cutout portion without being divided.

Thus, when the liner 7 is rotating, the rotational position of the valve element 14*b* inside the cylinder portion 14*a* is located by means of the centrifugal force caused by the revolution of the valve element 14*b* obtained from the rotation of the liner 7 so that the cutout portion 14*b*' of the valve element 14*b* is directed to the center side of the rotation axis of the liner 7 (the state shown in the lower part of FIG. 2). This increases the overlapping area between an opening of the hydraulic fluid flow path 14*c* of the cylinder portion 14*a* and the cutout portion 14*b*' of the valve element 14*b*, and the flow rate of the hydraulic fluid via the hydraulic fluid flow path 14*c* and the cutout portion 14*b*' of the valve element 14*b* is not restricted.

On the other hand, the rotational position of the valve element 14*b* inside the cylinder portion 14*a* is changed by the inertial force caused by the rotation of the valve element 14*b* obtained from the sudden braking of the liner 7 at the time of generation of the pulse so that the cutout portion 14*b*' of the valve element 14*b* is directed toward the direction other than the center side of the rotation axis of the liner 7 (the state shown in the upper side of FIG. 2). This decreases (or substantially decreases) the overlapping area between the opening of the hydraulic fluid flow path 14*c* of the cylinder portion 14*a* and the cutout portion 14*b*' of the valve element 14*b*, and the flow rate of the hydraulic fluid via the hydraulic fluid flow path 14*c* and the cutout portion 14*b*' of the valve element 14*b* is restricted.

Since the degree of restriction of the flow rate of the hydraulic oil varies depending on the magnitude of the braking of the liner 7 at the time of generation of the pulse, it is possible to improve the accuracy of the magnitude of the striking torque generated by a striking torque generation device of the hydraulic torque wrench and shorten the generation cycle of the striking torque, thereby enhancing the work efficiency.

The valve element 14*b* made of a columnar material can improve mechanical properties such as wear resistance by applying chrome plating to a steel rod, and each of ends 14*b*" of the valve element 14*b* can be supported by a steel ball 14*d*. This makes it possible to smoothen the rotational motion of the valve element 14*b*.

Then, the striking torque generation device of the hydraulic torque wrench increases the accuracy of the magnitude of the striking torque generated by the striking torque generation device of the hydraulic torque wrench at the time of rotating in both directions, i.e., during normal rotation (tightening) and reverse rotation (loosening), shortens the generation period of the striking torque, and also improve the durability of the striking torque generation device of the hydraulic torque wrench. In addition thereto, the following effects are provided.

(1) The conventional striking torque adjustment device of the hydraulic torque wrench has used springs 11*c* and 15*c* for the output adjustment mechanism 11 which adjusts the magnitude of the striking torque. However, the striking torque adjustment device of the hydraulic torque wrench of the present invention does not use such a spring, and therefore the durability can be improved.

Figure 4A:
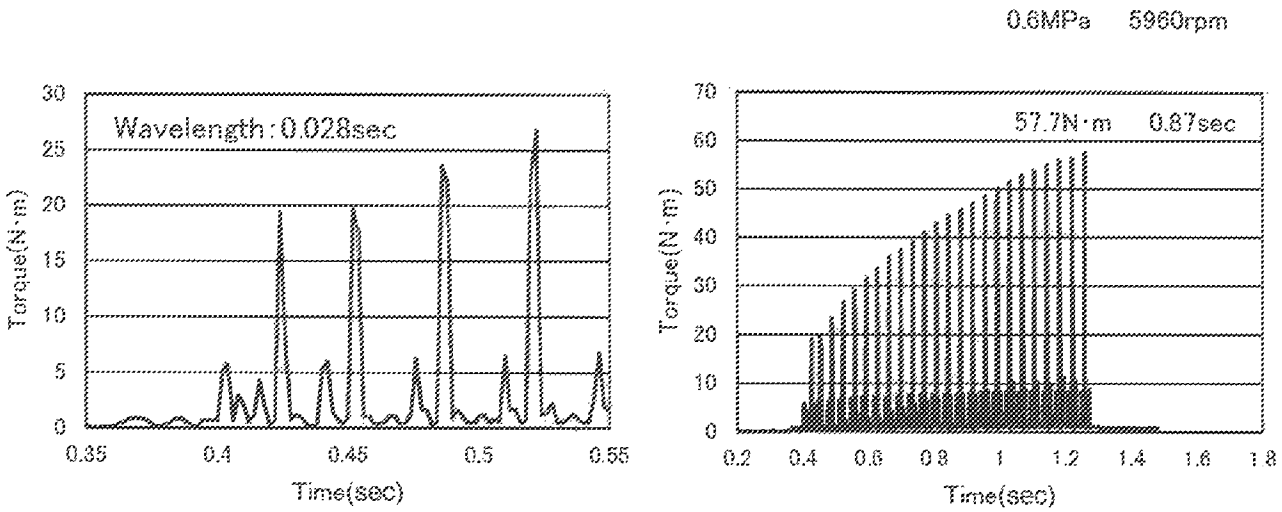
FIGS. 4(*a*) and 4(*b*) illustrate an output characteristic diagram.
Figure 4B:
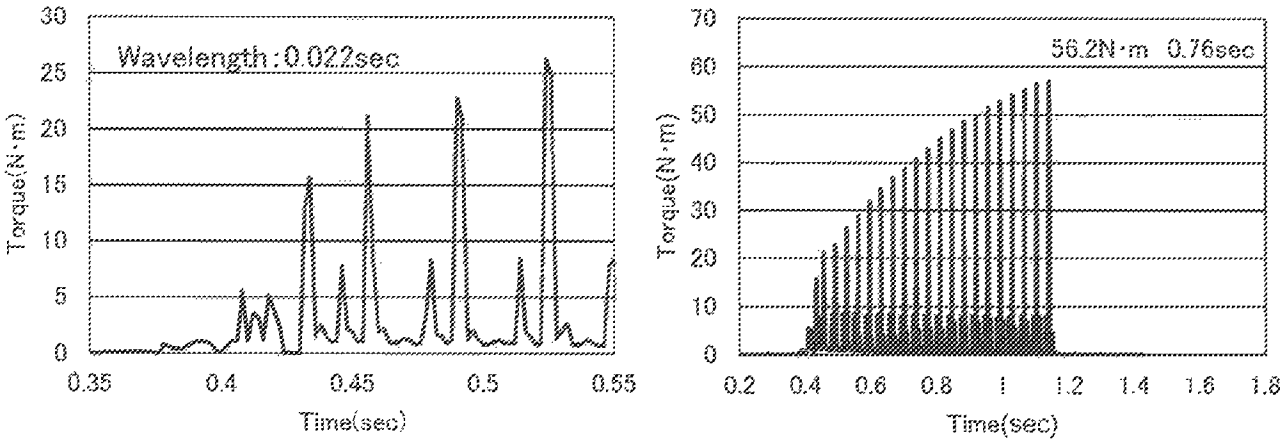

(2) The conventional striking torque adjustment device of the hydraulic torque wrench have had a limitation in size of the hydraulic fluid flow path when it is opened. However, the striking torque adjustment device of the hydraulic torque wrench of the present invention does not undergo such a restriction, and therefore the energy efficiency can be improved (compared to the conventional example (Patent Document 4) in FIGS. 4(*a*) and 4(*b*) in which high pressure air at 0.6 MPa is supplied to the rotor 4 (air motor), Example in FIG. 4(*b*) could reduce the time required for the tightening work from 0.87 seconds to 0.76 seconds).

Figure 5A:
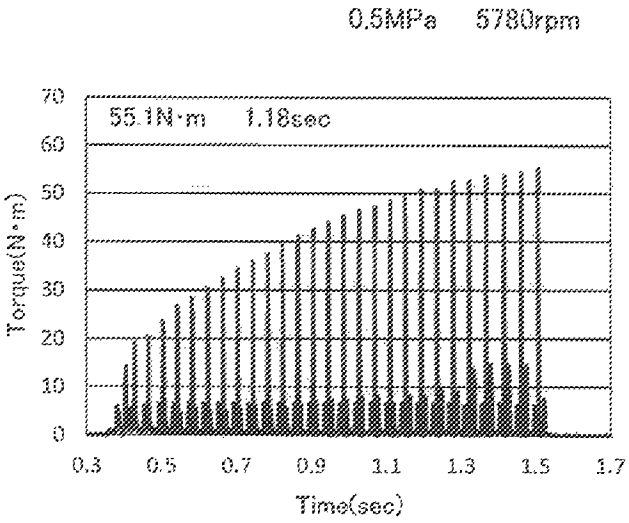
FIGS. 5(*a*) and 5(*b*) illustrate an output characteristic diagram.
Figure 5B:
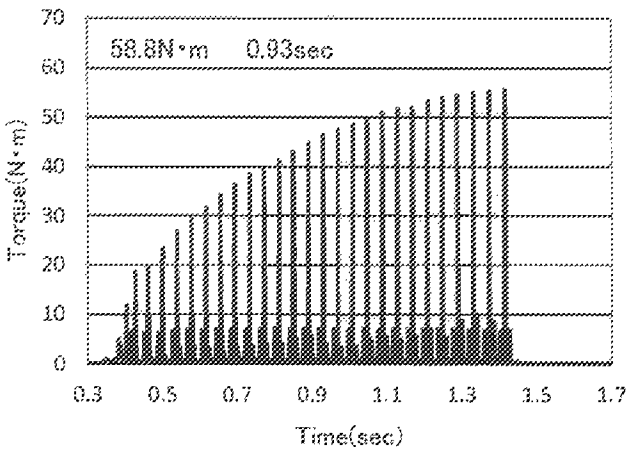
Figure 6:
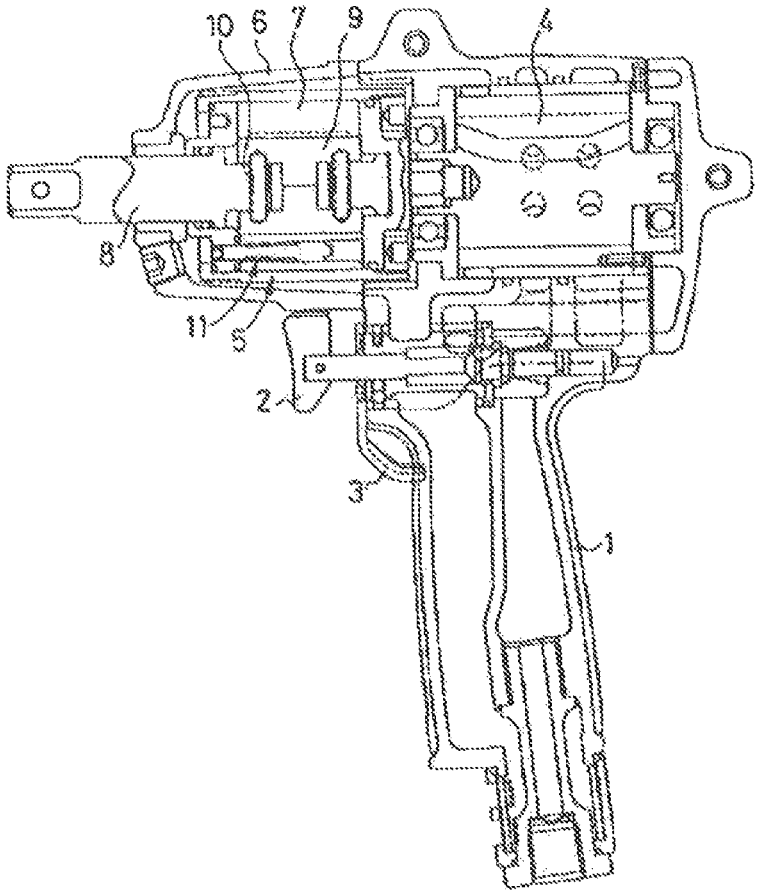
FIG. 6 is an overall front cross-sectional view illustrating a conventional striking torque adjustment device of a hydraulic torque wrench.

(3) The striking torque adjustment device of the hydraulic torque wrench adjusts the flow rate of hydraulic oil by means of the pressure of the hydraulic oil, and thus has been susceptible to fluctuations in oil quantity. The striking torque adjustment device of the hydraulic torque wrench of the present invention can adjust the flow rate of the hydraulic oil irrespective of the pressure of the hydraulic oil, and therefore is less affected by fluctuation in oil quantity due to leakage of the hydraulic oil by long term use of the hydraulic torque wrench, thereby making it possible to maintain the stable operating status over a long period of time (compared to the conventional example (Patent Document 4) in FIG. 5(*a*) in which the filling amount of hydraulic oil is reduced 0.8 ml from the normal and the high pressure air at 0.5 MPa is supplied to the rotor 4 (air motor), Example in FIG. 5(*b*) could reduce the time required for the tightening work from 1.18 seconds to 0.93 seconds).

Figure 7:
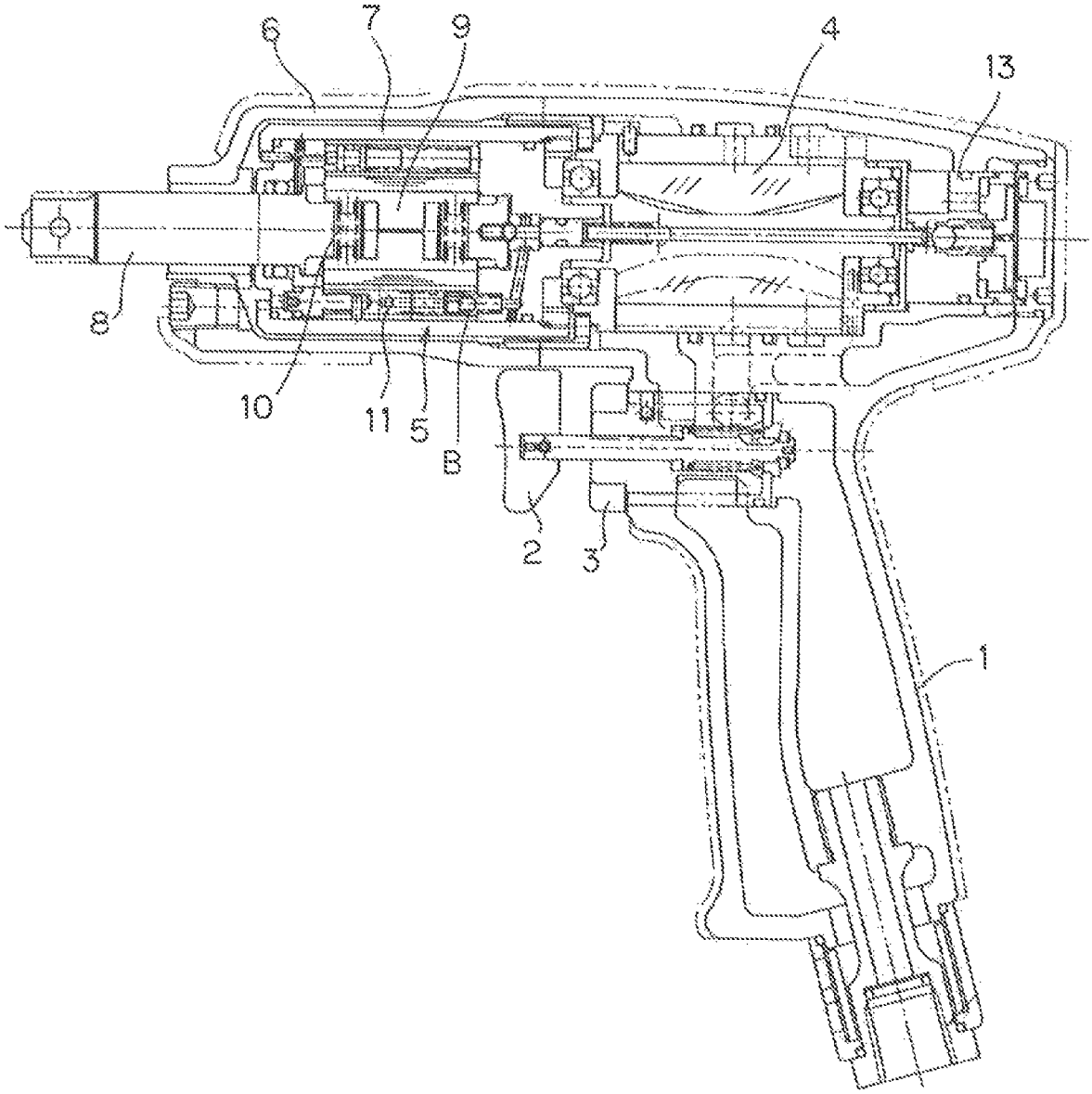
FIG. 7 is an overall front cross-sectional view illustrating a conventional striking torque adjustment device of a hydraulic torque wrench.
Figure 8:
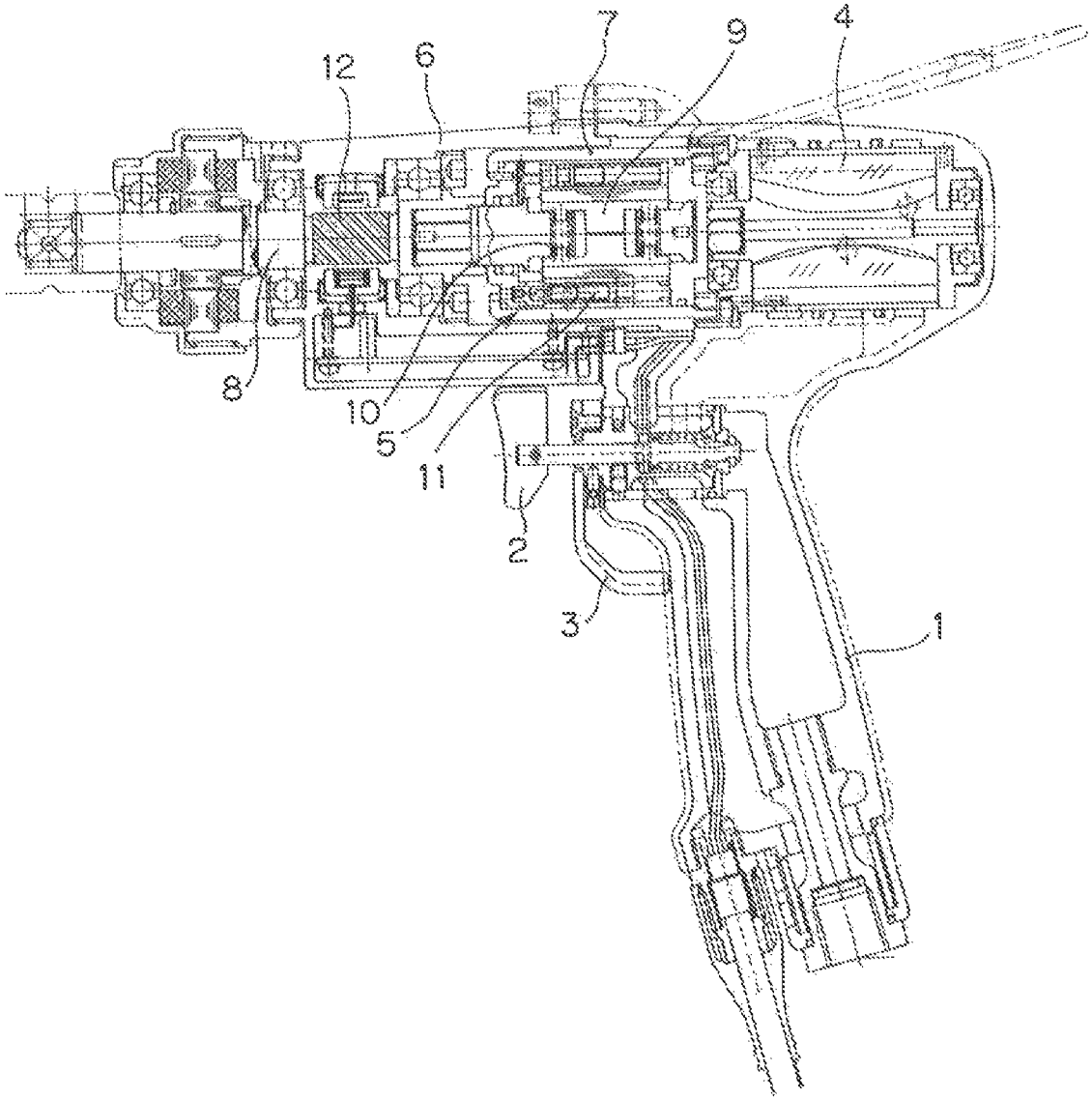
FIG. 8 is an overall front cross-sectional view illustrating a conventional striking torque adjustment device of a hydraulic torque wrench.
Figure 9A:
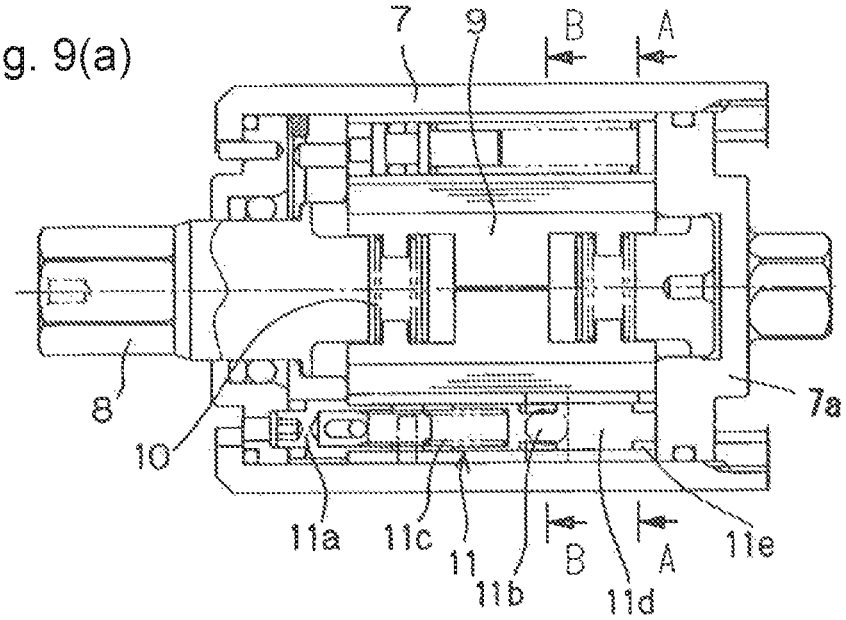
FIGS. 9(*a*)-9(*d*) are explanatory views of the main part of the conventional striking torque adjustment device of the hydraulic torque wrench.
Figure 9B:
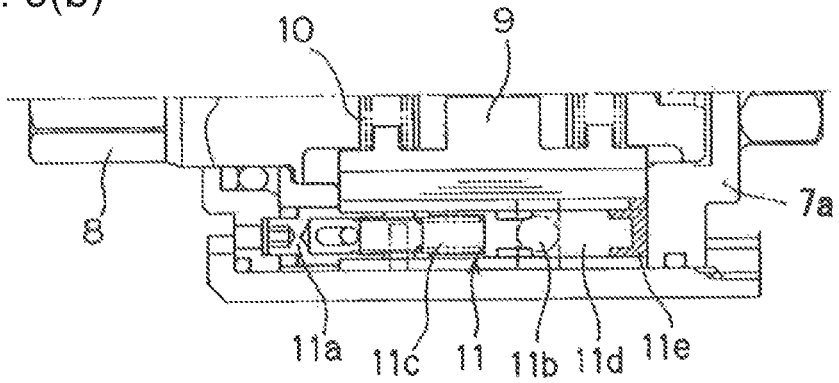
Figure 9D:
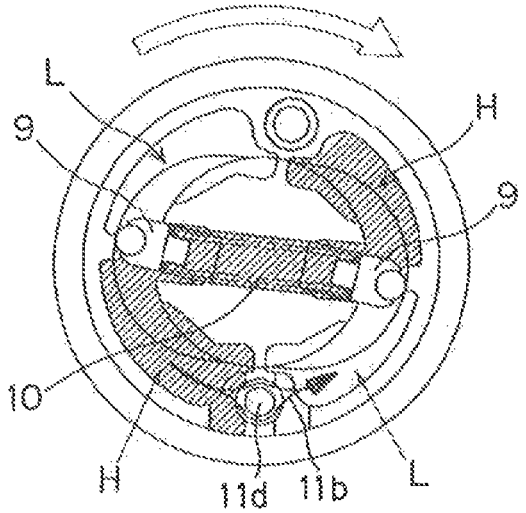
Figure 9C:
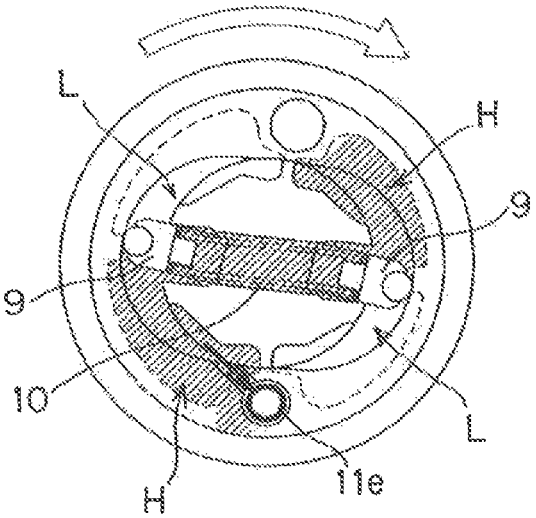
Figure 10B:
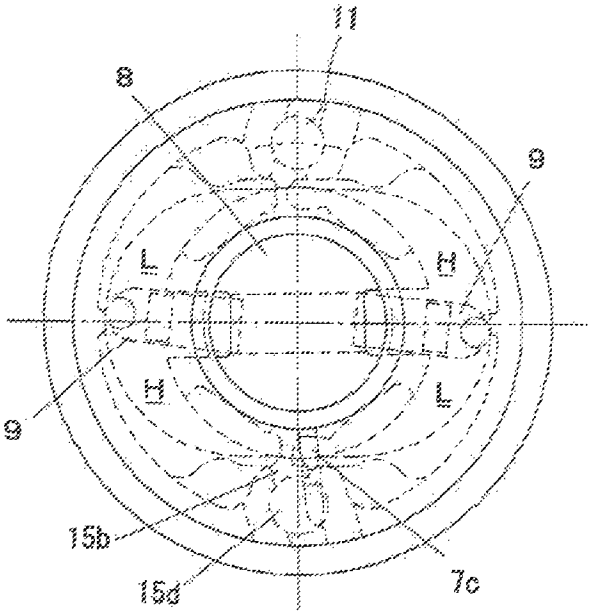
FIGS. 10(*a*) and 10(*b*) illustrate a conventional striking torque adjustment device of a hydraulic torque wrench.
Figure 10A:
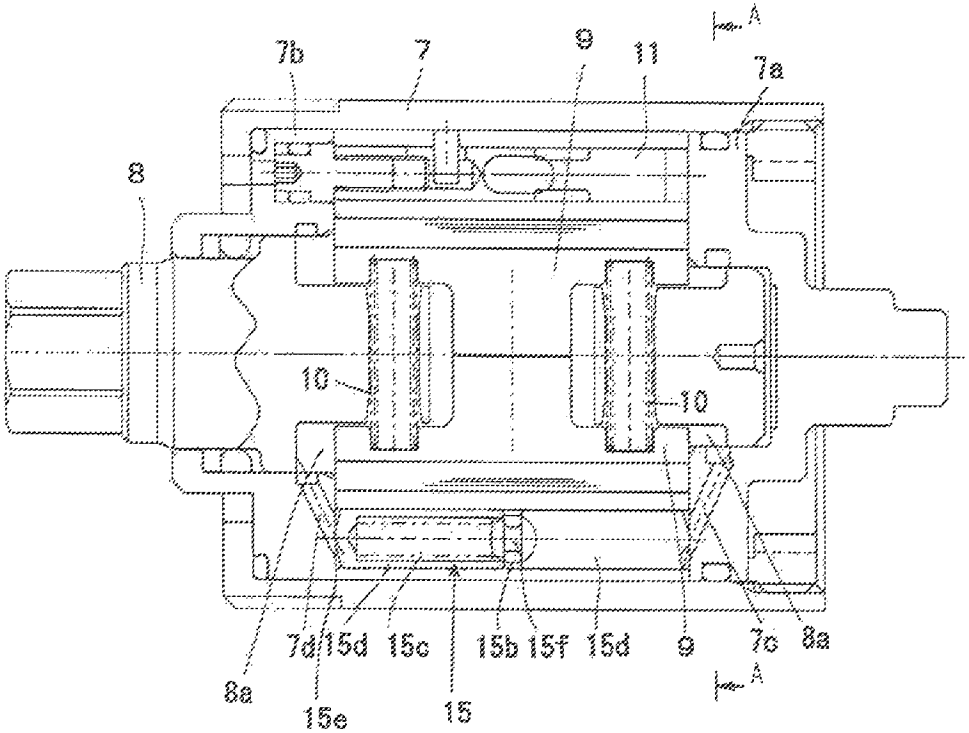
Figure 11:
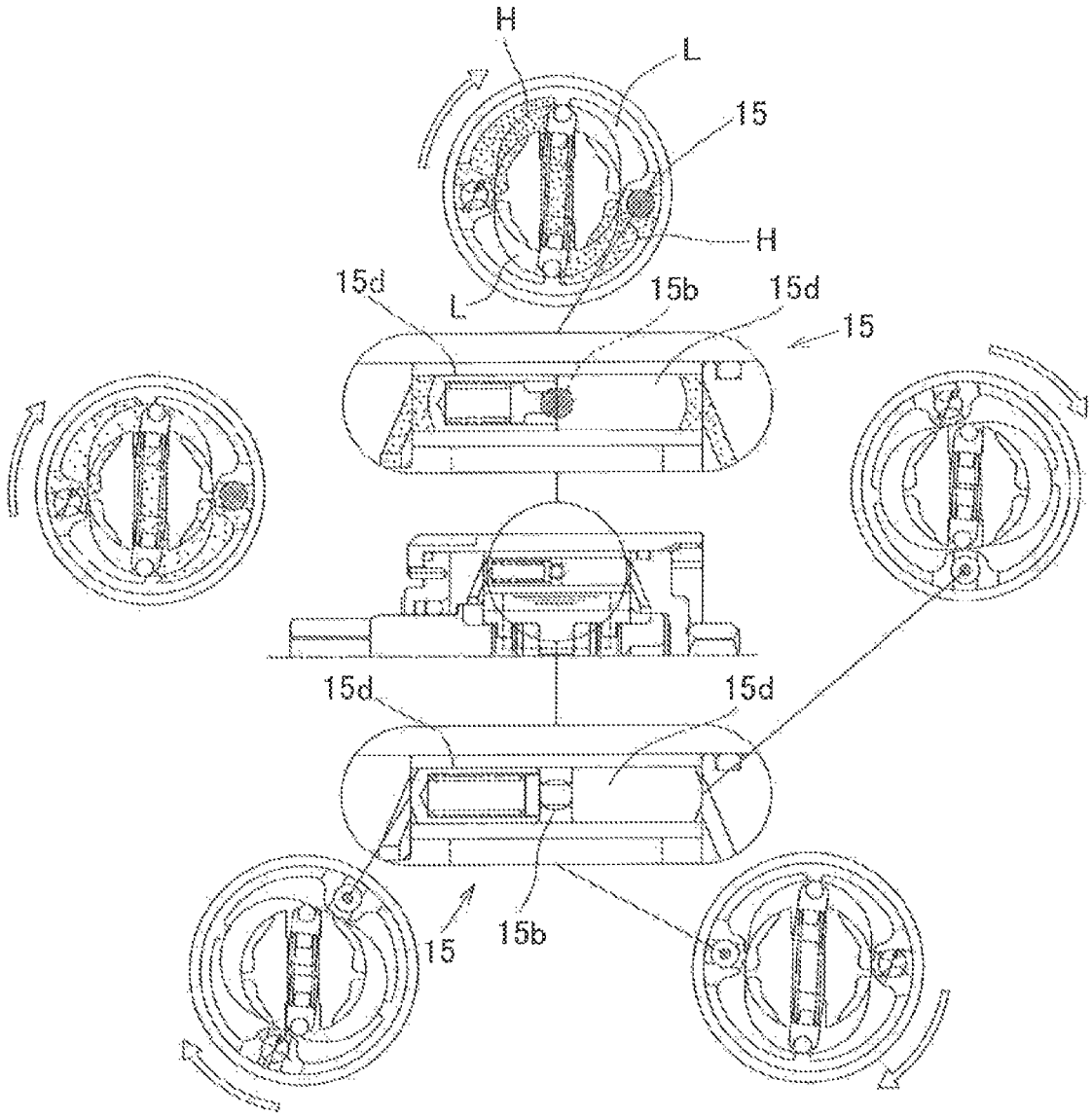
FIG. 11 is an operation explanatory view of a conventional striking torque adjustment device of a hydraulic torque wrench.

The striking torque adjustment device of the hydraulic torque wrench of the present invention has been described above based on the embodiment therefor. However, the present invention is not limited to the configuration described in the above embodiment, but the configuration can be modified as appropriate without departing from the spirit of the invention; that is, an electric motor may be used instead of the rotor 4 (air motor) that generates rotating torque with high-pressure air; and, instead of controlling the drive thereof by the output from the torque detection mechanism such as the magnetostrictive torque detection mechanism 12, the output adjustment mechanism 11 is provided with a relief valve B, similar to the conventional hydraulic torque wrench disclosed in FIG. 7, o that, when the tightening operation progresses and the hydraulic fluid pressure (striking torque) in the high-pressure chamber H reaches the set magnitude, the relief valve B is released and the hydraulic fluid pressure is transferred to a shut-off valve mechanism 13.

INDUSTRIAL APPLICABILITY

The striking torque adjustment device of the hydraulic torque wrench of the present invention has the characteristics making it possible to improve the accuracy of the magnitude of the striking torque generated by a striking torque generation device of the hydraulic torque wrench, shorten the generation cycle of the striking torque, and furthermore improve the durability and energy efficiency of the striking torque generation device of the hydraulic torque wrench, as well as making the device less susceptible to fluctuation in oil quantity. Therefore, it may be suitable for use in hydraulic torque wrench applications that use a hydraulic striking torque generation device.

EXPLANATION OF REFERENCE NUMERALS

1 Hydraulic torque wrench
2 Main valve
3 Normal-reverse rotation switching valve
4 Rotor
5 Striking torque generation device
6 Case
7 Liner
7*a* Liner upper lid
7*b* Liner lower lid
7*c* Flow path
7*d* Flow path
8 Main shaft
8*a* Blade insertion portion
9 Blade
10 Spring
11 Output adjustment mechanism
11*a* Operating shaft
11*b* Hydraulic fluid flow path
11*c* Spring
11*d* Valve element
11*e* Oil chamber
12 Magnetostrictive torque detection mechanism
13 Shut-off valve mechanism
14 Automatic relief mechanism
14*a* Cylinder portion
14*b* Valve element

14*b*' Cutout portion
14*c* Hydraulic fluid flow path (Opening)
14*d* Steel Ball
15 Automatic relief mechanism
15*b* Hydraulic fluid flow path
15*c* Spring
15*d* Valve element
15*e* Oil chamber
15*f* Spring receiver and guide
B Relief valve
H High-pressure chamber
L Low-pressure chamber

The invention claimed is:

1. A striking torque adjustment device of hydraulic torque wrench having a liner rotated by a rotor, and a main shaft and a blade disposed inside of the liner, wherein:

said liner is provided with a cylinder portion formed in parallel to the rotation axis, and also a hydraulic fluid flow path is formed which opens to the cylinder portion to communicate with the interior of the liner serving as a high-pressure chamber and a low-pressure chamber at the time of occurrence of a striking torque;

a cylindrical valve element having a cutout portion serving as a flow path for hydraulic oil formed on the outer peripheral surface portion is disposed inside said cylinder portion so as to be freely rotatable;

the rotational position of the valve element changes inside the cylinder portion by means of centrifugal force caused by the revolution of the valve element obtained from rotation of said liner and an inertial force caused by the rotation of the valve element obtained from the sudden braking of the liner at the time of generation of the pulse; and an automatic relief mechanism is provided in which the change in the rotational position of said valve element inside the cylinder portion changes the overlapping area of the hydraulic fluid flow path of the cylinder portion and the cutout portion of the valve element so as to adjust the flow rate of the hydraulic fluid from the side of the high-pressure chamber to the side of the low-pressure chamber via the hydraulic fluid flow path and the cutout portion of the valve element.

2. The striking torque adjustment device of hydraulic torque wrench according to claim 1, each of ends of said valve element is supported by a steel ball.

* * * * *